US008734139B2

(12) United States Patent
Burns et al.

(10) Patent No.: US 8,734,139 B2
(45) Date of Patent: May 27, 2014

(54) PUMPS AND PUMP HEADS COMPRISING VOLUME-COMPENSATION FEATURE

(75) Inventors: Stephen Michael Burns, Portland, OR (US); Charles F. Carr, Battle Ground, WA (US); David J. Grimes, Beaverton, OR (US)

(73) Assignee: Micropump, Inc., Vancouver, WA (US)

( * ) Notice: Subject to any disclaimer, the term of this patent is extended or adjusted under 35 U.S.C. 154(b) by 337 days.

(21) Appl. No.: 13/174,463

(22) Filed: Jun. 30, 2011

(65) Prior Publication Data

US 2012/0003107 A1 Jan. 5, 2012

Related U.S. Application Data

(60) Provisional application No. 61/360,835, filed on Jul. 1, 2010.

(51) Int. Cl.
*F04B 11/00* (2006.01)
*F01B 31/14* (2006.01)

(52) U.S. Cl.
CPC ..... *F04B 11/0033* (2013.01)
USPC ..... 417/540; 92/60; 92/80

(58) Field of Classification Search
USPC ..... 417/540; 92/60, 80
See application file for complete search history.

(56) References Cited

U.S. PATENT DOCUMENTS

| | | | | | |
|---|---|---|---|---|---|
| 121,678 | A | * | 12/1871 | Snyder | 417/473 |
| 481,143 | A | * | 8/1892 | Hutchinson | 417/439 |
| 4,207,033 | A | * | 6/1980 | Drutchas et al. | 417/251 |
| 5,540,569 | A | * | 7/1996 | Altham et al. | 417/420 |
| 6,095,773 | A | * | 8/2000 | Merz | 417/540 |
| 6,431,823 | B1 | | 8/2002 | Slepoy | |
| 6,488,487 | B2 | * | 12/2002 | Minato | 417/540 |
| 7,798,783 | B2 | | 9/2010 | Burns et al. | |
| 2009/0060728 | A1 | | 3/2009 | Grimes et al. | |

FOREIGN PATENT DOCUMENTS

| | | | |
|---|---|---|---|
| EP | 1589228 | A1 | 10/2005 |
| EP | 1911976 | A2 | 4/2008 |

OTHER PUBLICATIONS

International Search Report for corresponding International Application No. PCT/US2011/042653, 3 pages, mailed Feb. 21, 2012.

* cited by examiner

*Primary Examiner* — Charles Freay
(74) *Attorney, Agent, or Firm* — Klarquist Sparkman, LLP

(57) ABSTRACT

A fluid pump having a pump housing that includes at least one expansion joint, provides volume compensation, as needed, to adjust for changes in pressure in the pump housing. Various embodiments automatically and passively reduce static pressure in the pump housing associated with a freezing event, thereby preventing damage to the pump head. Volume compensation is achieved by employing, in each expansion joint, a dynamic seal that allows relative movement of two portions of the pump housing, and a bias that provides a selected counter-force to the movement of the housing portions. The subject pumps are particularly suited for use in automotive and other rugged applications, in which fluid pumps may experience recurring freezing events.

11 Claims, 6 Drawing Sheets

(PRIOR ART)

PUMPS AND PUMP HEADS COMPRISING VOLUME-COMPENSATION FEATURE

CROSS-REFERENCE TO RELATED APPLICATION

This claims the benefit of U.S. Provisional Patent Application No. 61/360,835, filed on Jul. 1, 2010, which is incorporated herein by reference in its entirety.

FIELD

This disclosure pertains to, inter alia, gear pumps and other pumps configured to operate in a substantially primed condition to urge flow of a fluid. The subject pumps and pump heads include various types having one or more rotary pumping members, such as meshed gears, or at least one pumping member that operates continuously in a cyclic manner. More specifically, the disclosure pertains to pumps and pump heads capable of accommodating a change in internal volume in the pump head caused by, for example, a freezing event, a pressure fluctuation, or the like involving fluid in the pump head.

BACKGROUND

Several types of pumps are especially useful for pumping fluids with minimal back-flow and that are amenable to miniaturization. An example is a gear pump. Another example is a piston pump. A third example is a variation of a gear pump in which the rotary pumping members have lobes that interdigitate with each other. Gear pumps and related pumps have experienced substantial acceptance in the art due to their comparatively small size, quiet operation, reliability, and cleanliness of operation with respect to the fluid being pumped. Gear pumps and related pumps also are advantageous for pumping fluids while keeping the fluids isolated from the external environment. This latter benefit has been further enhanced with the advent of magnetically coupled pump-drive mechanisms that have eliminated leak-prone hydraulic seals that otherwise would be required around pump-drive shafts.

Gear pumps have been adapted for use in many applications, including applications requiring extremely accurate delivery of a fluid to a point of use. Consequently, these pumps are widely used in medical devices and scientific instrumentation. Developments in many other areas of technology have generated new venues for accurate pumps and related fluid-delivery systems. Such applications include, for example, delivery of liquids in any of various automotive applications.

Automotive applications are demanding from technical, reliability, and environmental viewpoints. Technical demands include spatial constraints, ease of assembly and repair, and efficacy. Reliability demands include requirements for high durability, vibration-resistance, leak-resistance, maintenance of hydraulic prime, and long service life. Environmental demands include internal and external corrosion resistance, and ability to operate over a wide temperature range.

A typical automotive temperature range includes temperatures substantially below the freezing temperature of water and other dilute aqueous liquids. These temperatures can be experienced, for example, whenever an automobile is left out in freezing winter climate. A property that is characteristic of water and most aqueous solutions is that they tend to expand as they undergo a phase change from liquid to solid (ice). As is well known, household plumbing systems exposed to sub-freezing temperatures may develop static pressures produced by freeze-expansion that are sufficiently high to fracture pipes. Thus, these pressures can cause substantial damage to a pump that is coupled, in a primed condition, to a hydraulic circuit exposed to a sub-freezing temperature.

In view of the above, a simple solution is to add anti-freeze to the liquid or to constitute the liquid with sufficient solute to depress its freezing point. Unfortunately, changing the liquid in these ways changes the composition and possibly other important properties of the liquid, which may render the liquid ineffective for its intended purpose.

U.S. Pat. No. 8,323,008, (hereinafter the "'008 patent"), discloses pumps and pump heads comprising internal pressure-absorbing member(s) for alleviating at least some of a pressure increase occurring inside the pump head. The pressure-absorbing member is located inside the pump housing at a non-wearing location and contacts the fluid being pumped by the pump head. The pressure-absorbing member has a compliant property to exhibit a volumetric compression when subjected to a pressure increase in the fluid contacting the pressure-absorbing member. Pumps and pump heads as disclosed herein take a different approach to alleviating pressure inside the pump head.

SUMMARY

Generally provided herein are disclosures of pumps and pump heads that, when primed, can volumetrically compensate for, or at least partially offset changes in, internal volume so as to nullify or at least reduce corresponding changes of internal pressure in the pump head that otherwise would be caused by the internal-volume changes. The change in internal pressure can be static, as in a freezing event, or it can be dynamic.

The term "fluid" is meant to encompass liquids and other substances, such as, for example, gels, pastes, slurries, high-viscosity liquids, and the like, that share at least some properties of liquids. The devices, systems, and methods described herein may, in certain instances, be applicable to gaseous-type fluids.

The subject pumps and pump heads operate in a substantially primed condition. Because liquids are substantially non-compressible, conventional pumps operating in a primed condition are vulnerable to pressure damage if liquid in the pumps is allowed to freeze and possibly undergo freeze-expansion. In a conventional primed pump, it may be very difficult or impossible for the liquid to find additional hydraulic space for expansion as the liquid freezes. Pumps and pump heads as disclosed herein are equipped with expansion features that automatically provide additional hydraulic space, as needed, to accommodate these pressure increases. This provision of additional hydraulic space may occur repeatedly over an indefinite time period and can be maintained in a static manner, which is effective for reducing pressure increases within the pump that accompanying freezing of the liquid in the pump.

The various embodiments are particularly effective for reducing static pressure accompanying events such as freezing events. The events may occur occasionally or regularly (such as every night in a freezing cold external environment). The reduction in pressure is achieved by the pump housing or portion thereof expanding a corresponding amount in a defined direction. The expansion is automatic and passive, occurs without external leaks, and is automatically reversible as external conditions change. In addition, any of the embodiments disclosed herein can include at least one internal pressure-absorbing member as disclosed in the '008 patent cited above. Such a combination of an expansion joint and a pressure-absorbing member is particularly effective for alleviating both dynamic and static pressures.

Various embodiments of a pump comprise a pump housing defining a pump cavity that has at least one inlet, and at least one outlet. The pump includes a movable pumping member situated in the pump cavity. The pumping member, when driven to move, urges flow of the liquid from the inlet through the pump cavity to the outlet. The pump exhibits volumetric (and hence pressure) compensation, but in a manner that is different from the manner discussed in the patent cited above. Specifically, the pump housing in this embodiment comprises walls that can be termed "pressure-boundary" walls. Pressure compensation is provided by the pump housing correspondingly changing the area of at least one of (or a portion of) its pressure boundary walls in response to a pressure change inside the pump housing. For example, the pump housing has first and second portions, wherein the second portion is movable in a particular direction relative to the first portion in a way that increases or decreases the volume inside the pump housing. This movement occurs without the pump head "breaking prime," by means of a dynamic seal. An increased volume inside the housing causes a corresponding pressure decrease inside the housing. In the '008 patent, in contrast, the area of the housing walls is kept substantially fixed while, inside the housing, a pressure-absorbing member changes its volume in response to a pressure increase in the housing. It is understood that the internal force necessary to expand the housing must be less than the burst strength of the housing. Otherwise, the housing could burst during a freezing event before the dynamic seal releases movement of the housing portions.

In the subject embodiments, the internal pressure-absorbing member can be omitted because the housing wall, by making pressure-responsive changes in surface area, achieves the desired corresponding reduction of pressure inside the housing. In other embodiments, however, the features of embodiments described herein may be used in conjunction with features disclosed in the '008 patent.

In certain embodiments of the pump, the movable pumping member comprises a rotatable pumping member, such as at least one gear. These gear-including embodiments typically have at least one "driving" gear and at least one "driven" gear that contra-rotate about their respective axes in the usual manner of gear pumps. In other embodiments the movable pumping member comprises at least one piston that typically undergoes a reciprocating motion.

The operable part of a pump, aside from the "mover" used to actuate the pump, is often referred to as a "pump head." Pump heads can be manufactured and distributed as modular units that can be coupled to various movers. Example movers are any of various types of motors that can be coupled directly or indirectly to the movable pumping member in the pump head. Actuation of the mover causes corresponding motion of the movable pumping member in a pump cavity. An example mover includes a magnet coupled to the movable pumping member, and a magnet driver magnetically coupled to the magnet to move the magnet (e.g., rotate it about its axis) and thus move the pumping member in a pump cavity. Pumps including magnetic movers are generally termed "magnetically actuated" pumps. Such pumps are advantageous because they do not require dynamic seals such as shaft seals, which are prone to leaks. Alternatively, the mover can include a mechanical, rather than magnetic, coupling to the movable pumping member such as, for example, a direct coupling to the armature of an electrical motor.

Any of various embodiments of the pump can further include one or more sensors in fluid communication with the liquid in the pump housing. Example sensors include, but are not limited to, pressure sensors, temperature sensors, flow sensors, chemical sensors, and the like.

This disclosure pertains to gear pump heads as well as to gear pumps. Each of several embodiments of a gear pump head comprise a pump housing that defines a gear-cavity, at least one inlet hydraulically coupled to the gear-cavity, at least one outlet hydraulically coupled to the gear-cavity, and at least one interior non-wearing location that contacts fluid in the pump housing. At least one driving gear and one driven gear are enmeshed with each other in the gear-cavity. The housing of the gear pump head can further include a cup-housing (also termed a "magnet cup"). The magnet cup defines a magnet-cup-cavity in hydraulic communication with the gear-cavity. The magnet-cup-cavity contains the liquid and a rotatable driven magnet that is coupled to the driving gear such that rotation of the driven magnet about its axis causes corresponding rotation of the driving gear and thus of the driven gear. These embodiments can impart rotation to the magnet by magnetically coupling the magnet to a second magnet, called a "driving" magnet mounted on the armature of a motor. Alternatively, rotation of the driven magnet can be caused by placing a stator in coaxial surrounding relationship to, but outside of, the magnet cup. The stator is magnetically coupled to the driven magnet so as to cause, whenever the stator is electrically energized, rotation of the driven magnet. This latter embodiment eliminates the need for a driving magnet.

This disclosure also pertains to hydraulic circuits such as those used in automobiles and other vehicles. An exemplary hydraulic circuit comprises a pump, such as any of the embodiments disclosed herein, a liquid source hydraulically connected upstream of the pump to the pump inlet, and a liquid-discharge port hydraulically connected downstream of the pump to the pump outlet. The pump can be, by way of example, a gear pump or a piston pump, but it will be understood that these specific pumps are not intended to be limiting. It is contemplated that various other specific types of pumps can readily include a volume-compensation feature as discussed herein.

This disclosure also pertains to methods, in the context of a method for pumping a liquid using a substantially primed pump, for preventing a fluid cavity of the pump from experiencing at least a threshold magnitude of pressure increase within the fluid cavity. The threshold magnitude can be, for example, a pressure condition generated in the fluid cavity if the liquid in the fluid cavity became at least partially frozen and experienced a corresponding increase in volume. Alternatively or in addition, the threshold magnitude may be a pressure condition generated in the fluid cavity as a result of a pressure fluctuation of the liquid in the fluid cavity accompanying operation of the pump.

DETAILED DESCRIPTION

As used herein, the singular forms "a," "an," and "the" include the plural forms unless the context clearly dictates otherwise. Additionally, the term "includes" means "comprises." Further, the term "coupled" encompasses mechanical as well as other practical ways of coupling or linking items together, and does not exclude the presence of intermediate elements between the coupled items.

The devices, systems and methods described herein should not be construed as being limiting in any way. Instead, this disclosure is directed toward all novel and non-obvious features and aspects of the various disclosed embodiments, alone and in various combinations and sub-combinations with one another. The disclosed devices, systems and methods are not limited to any specific aspect or feature or combinations thereof, nor do the disclosed devices, systems and methods require that any specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed devices, systems and methods can be used in conjunction with other devices, systems and methods. Additionally, the description sometimes uses terms like "produce" and "provide" to describe the disclosed methods. These terms are high-level abstractions of the actual operations that are performed. The actual operations that correspond to these terms may vary depending on the particular implementation and are readily discernible by one of ordinary skill in the art.

In the following description, certain terms may be used such as "up," "down,", "upper," "lower," "horizontal," "vertical," "left," "right," and the like. These terms are used, where applicable, to provide clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Certain general features of an exemplary gear pump 10 are depicted in FIGS. 1-5. The gear pump 10 may be magnetically driven. It will be understood that "gear" as used herein encompasses rotary members configured as conventional pump gears as well as any of various other rotary members having lobes, teeth or the like that interdigitate with the same of a second such member to produce fluid flow, when contra-rotated relative to each other.

Figure 1:
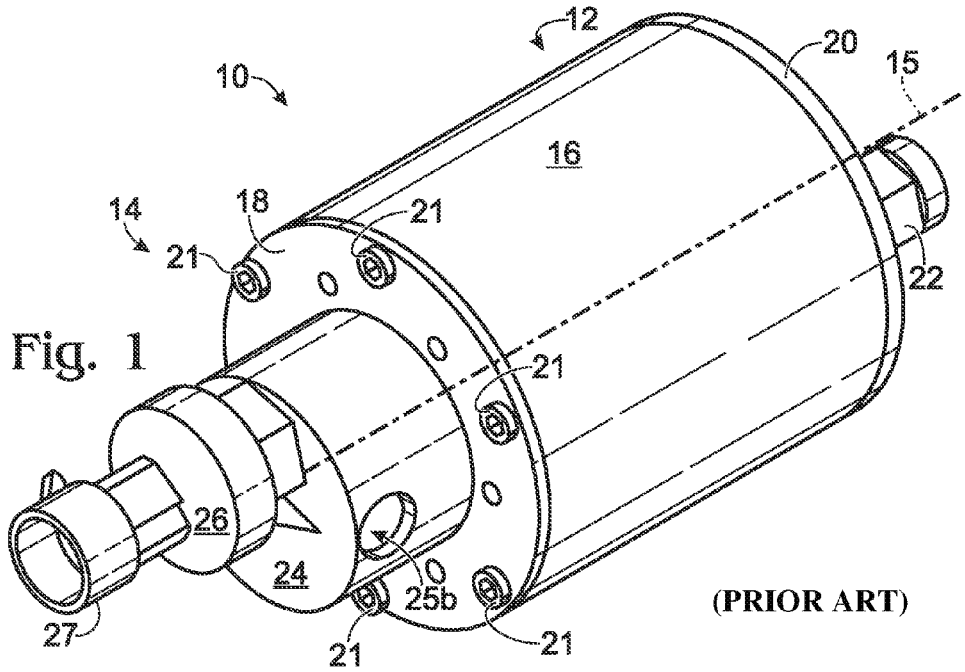
Fig. 1 (PRIOR ART)
FIG. 1 is a perspective view of a prior art magnetically driven gear pump.
Figure 2:
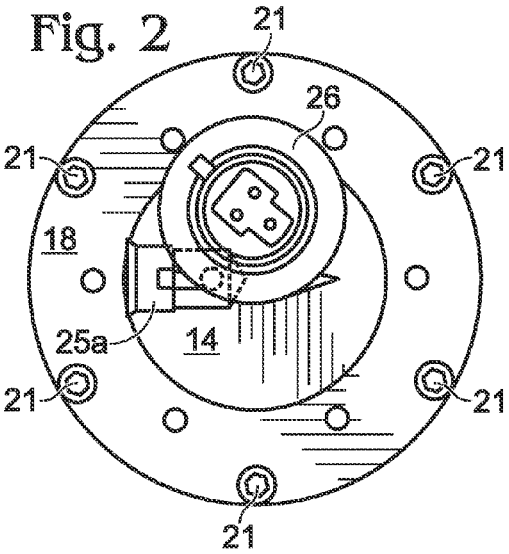
Fig. 2 (PRIOR ART)
FIG. 2 is an orthogonal end view of the gear pump shown in FIG. 1, in which the pump head is visible.
Figure 3:
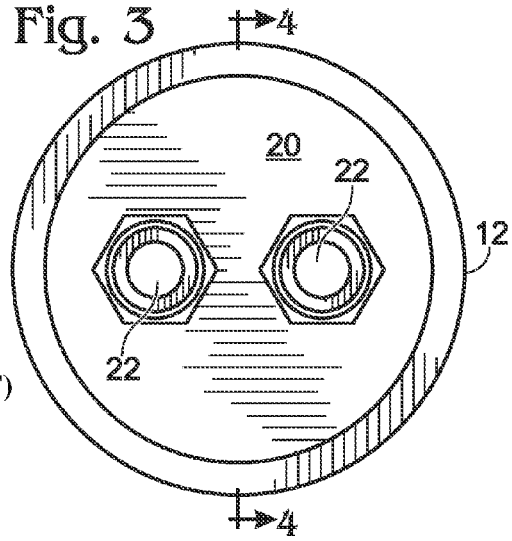
Fig. 3 (PRIOR ART)
FIG. 3 is an orthogonal end view of the gear pump shown in FIG. 1, in which the end-plate and electrical connections opposite the pump head are visible.

With reference to FIGS. 1-3, the pump 10 comprises an actuator portion 12 and a pump-head portion 14, which are symmetric about an axis 15. The actuator portion 12 comprises an outer casing 16, a first end-plate 18, and a second end-plate 20. The actuator portion 12 contains a "mover" for the pump-head portion 14, as described below. The end-plate 18 may be attached to the casing 16 by hexagonal bolts 21. The pump-head portion 14 includes a fitting block 24 that defines a fluid-inlet port 25*a* and a fluid-outlet port 25*b* (only the fluid-outlet port 25*b* is visible in FIG. 1, but the fluid-inlet port 25*a* is shown in FIG. 2). As shown in FIG. 3, the second end-plate 20 includes a pair of threaded electrical connectors 22.

Figure 4:
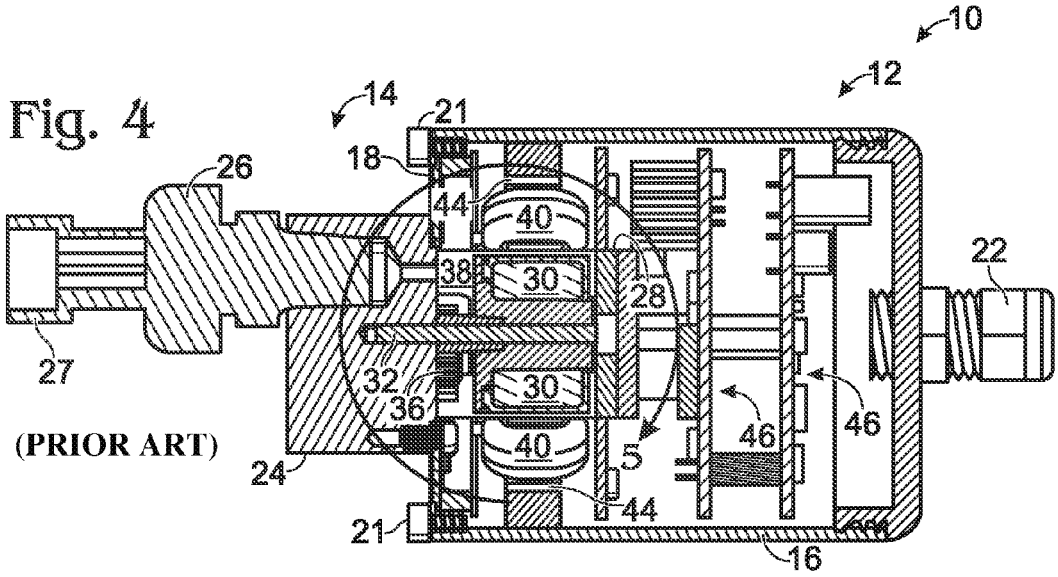
FIG. 4 is a cross-sectional view of the magnetically driven gear pump shown in FIG. 1.
Figure 5:
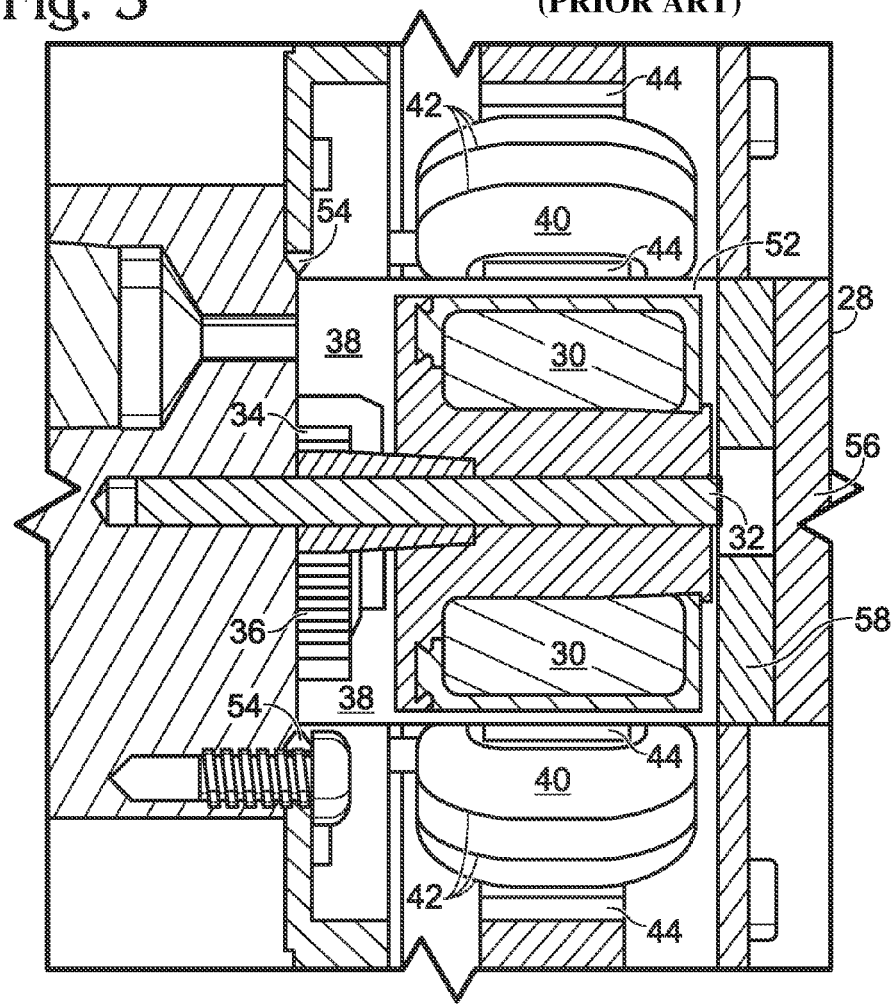
Fig. 5 (PRIOR ART)
FIG. 5 is a detail view of the cross-section shown in FIG. 4, in which the magnet-cup portion of the pump is magnified.

With reference to FIGS. 4 and 5, the pump-head portion 14 also includes a cup-housing 28 that contains a rotatable magnet 30 mounted to a shaft 32. The shaft 32 is mounted to a driving gear 34 that rotates and that is interdigitated (meshed) with a driven gear 36. The gears 34, 36 are situated in a gear-cavity 38 (a portion of the "pump cavity" that also includes the interior surfaces of the inlet and outlet ports). The gear-cavity 38 and the interior of the cup-housing 28 ("cup-cavity") are wetted by liquid being pumped by the pump 10. The magnet 30 has multiple magnetic poles that are magnetically coupled, in this embodiment, through the wall of the cup-housing 28, to a stator 40 contained within the outer casing 16. The stator 40 comprises wire windings 42 associated with a ferrous core 44 that surrounds, and is co-axial with, the cup-housing 28. The windings 42 are selectively energized by electronics 46 also contained within the outer casing 16. Power is supplied to the electronics 46 via the connectors 22. Thus, energization of the stator 40 causes axial rotation of the magnet 30, which rotates the driving gear 34, which in turn rotates the driven gear 36. This contra-rotation of the gears 34, 36 urges flow of liquid through the cavity 38. For improved operation with certain liquids, the cavity 38 optionally may include a suction shoe (not detailed).

The fitting block 24 defines passageways leading to and from the cavity 38 and connecting the cavity 38 to the inlet and outlet ports 25*a* and 25*b*. If desired or required, the fitting block 24 also includes a pressure transducer 26 (that can be hydraulically connected to the outlet port 25*b*, for example). The pressure transducer 26 includes an electrical connector 27, permitting electrical connection of the pressure transducer 26 in a manner that establishes, for example, feedback control of energization of the stator 40. The pressure transducer 26 and the electrical connector 27 may be skewed with respect to axis 15.

As shown in FIG. 5, the fitting block 24 is coupled to the end-plate 18 and is sealed against the rim of the cup-housing 28 to establish, within the cup-housing 28, a cup-cavity 52. The cup-cavity 52 is sealed using a static seal 54 (e.g., an O-ring). The cup-cavity 52 is in hydraulic communication with the gear-cavity 38, and hence both are wetted by the pumped liquid, as noted above. Also, during normal operation, at least the cup-cavity 52 and gear-cavity 38 are substantially primed with the liquid being pumped.

The gear pump 10 can be made of any of various materials that are inert to the particular fluid to be pumped. For example, a high performance organic polymer thermoplastic such as polyether ether ketone (PEEK) may be used to fabricate the gears 34, 36 and the cup-housing 28.

The range of candidate pump heads is not limited to heads for gear pumps. An exemplary alternative type of pump head is a valveless piston pump. A valveless piston pump is disclosed in, for example, U.S. Patent Publication No. 2007-0237658, incorporated herein by reference. See particularly FIG. 11 of the '658 reference and the accompanying discussion on pages 9-14 thereof.

The embodiment now to be described is directed to a pump head having a housing that provides volumetric compensation without the need for an internal pressure-absorbing member. The basic concepts of this embodiment are: (1) the housing comprises multiple (at least two) portions that are conjoined in such a way that at least one portion can move relative to another portion (or multiple portions can move relative to each other) to produce an alleviating volumetric response to a pressure change, such as a pressure increase inside the housing; (2) at least two portions of the housing are connected together at a housing expansion joint; (3) the expansion joint constrains relative motion of the housing portion(s) to a desired direction(s); (4) the expansion joint has a dynamic seal; and (5) the expansion joint has a bias (e.g., is spring-loaded).

A key feature in maintaining the seal integrity of the pump is the use of a dynamic seal that engages in the direction(s) that are constrained, while allowing at least one of the housing portions to move in one or more other directions (or axes) without leaking or breaking prime, thereby providing an expansion or contraction in housing volume in response to pressure inside the housing. The bias provides a restoring force that allows the expansion joint to be self-resetting. Alleviating a pressure increase can be sufficient to prevent freeze-expansion damage to the pump, and/or can be sufficient to reduce pressure fluctuations in the pumped liquid, such as at the outlet of the pump. Alleviation of pressure fluctuations is further facilitated by the ability of the movable portion of the pump housing to exhibit a volumetric contraction when subjected to a pressure decrease in the housing.

According to the present embodiment, volumetric (and hence pressure) compensation is achieved by the housing itself correspondingly changing the area of at least one of its pressure boundary walls or portion thereof. To illustrate, consider a pump housing such as any of the housings in the embodiments described above. The wall in substantially any part of the housing represents a pressure boundary, and hence is a pressure-boundary wall. (If there were no pressure difference across the wall, there would be little to no pumping action produced by the pump. This happens, for example, when a pump head loses prime.) The wall constitutes a pressure boundary because the pressure inside the housing is different (usually greater) than the pressure outside the wall. By definition, pressure is force per unit area, so a change in surface area of a pressure-boundary wall yields a corresponding change in pressure within the housing. As a portion of the pressure-boundary wall expands to increase the volume inside the housing it produces a corresponding increase in the surface area of the pressure-boundary wall, and in turn a corresponding pressure decrease inside the housing.

In contrast, in the pump heads disclosed in the '008 patent publication, the area of the pressure boundary is kept substantially constant as a pressure-absorbing member(s) inside the housing is compressed. Thus, the pressure-absorbing member(s) exhibit a reduction in thickness and an increase in surface area in response to the pressure increase. In the embodiments disclosed herein, in contrast, internal pressure-absorbing members can be omitted because the housing wall, by making pressure-responsive changes in surface area, achieves the desired corresponding reduction of pressure inside the housing.

Figure 6:
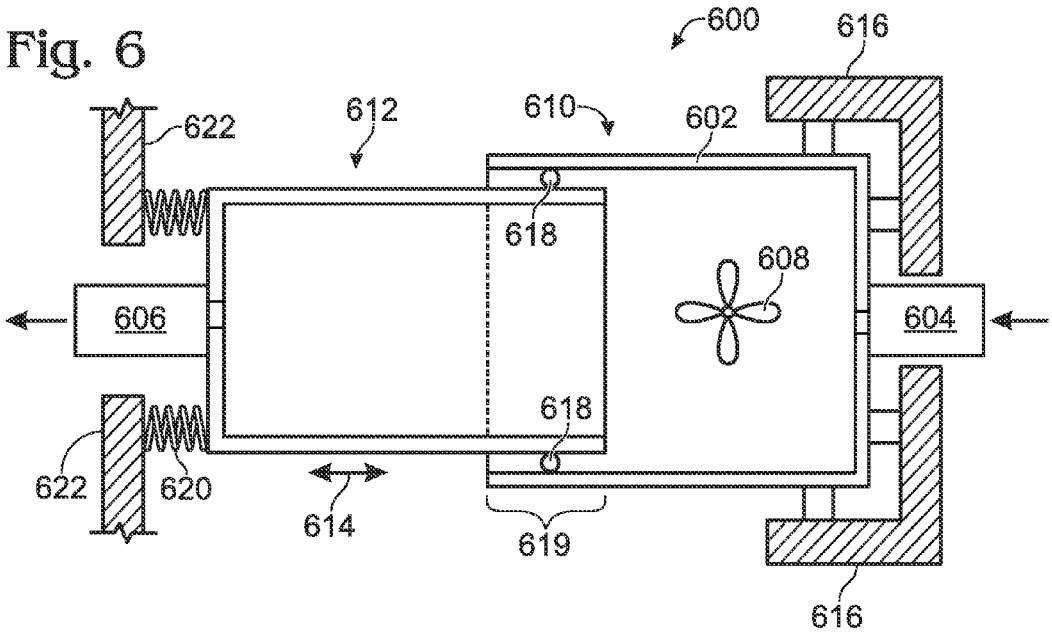
FIG. 6 is a schematic diagram of a first exemplary embodiment of a pump head equipped with a volume-compensation feature.

Reference is now made to FIG. 6, depicting a pump head 600. The pump head 600 includes a housing 602, an inlet 604, an outlet 606, and a pump element 608 (e.g., a rotor, piston, or set of pump gears). As the pump element 608 moves, fluid enters the pump head 600 through the inlet 604, passes through the housing 602, and exits through the outlet 606. The pump head 600 normally operates in a primed condition, and the pressure inside at least most portions of the housing 602 is normally greater than the pressure outside the housing. The housing 602 comprises a first portion 610 and a second portion 612. The second portion 612 is fitted to (e.g., slip-fitted in) the first portion 610 such that the second portion engages the first portion 610 in a manner allowing the second portion 612 to move relative to the first portion 610 in the horizontal direction 614 shown in FIG. 6. Thus, motion of the second portion 612 is constrained in substantially all but the horizontal direction 614. Meanwhile, motion of the first portion 610 is constrained by a fixed structure 616 from moving in any direction. The first and second portions 610, 612 are conjoined at a housing expansion joint 619, which may comprise compliance means such as, for example, a dynamic seal 618 (e.g., a ring seal such as an O-ring), or a bellows. The interior of the housing 602 remains sealed from the external environment regardless of motion of the second portion 612 relative to the first portion 610. Motion of the second portion 612 desirably is against a bias 620 (e.g., a compression spring) secured against stationary structure 622. The bias 620 and actuation of the pump element 608 establish a nominal pressure inside the housing 602. If the internal pressure increases, the second portion 612 moves to the left in FIG. 6, relative to the first portion 610, to increase the volume inside the housing 602 and thereby reduce the internal pressure. Likewise, if the internal pressure decreases, the second portion 612 automatically moves to the right in FIG. 6, relative to the first portion 610, to decrease the volume inside the housing 602 and thereby increase the internal pressure.

Figure 7:
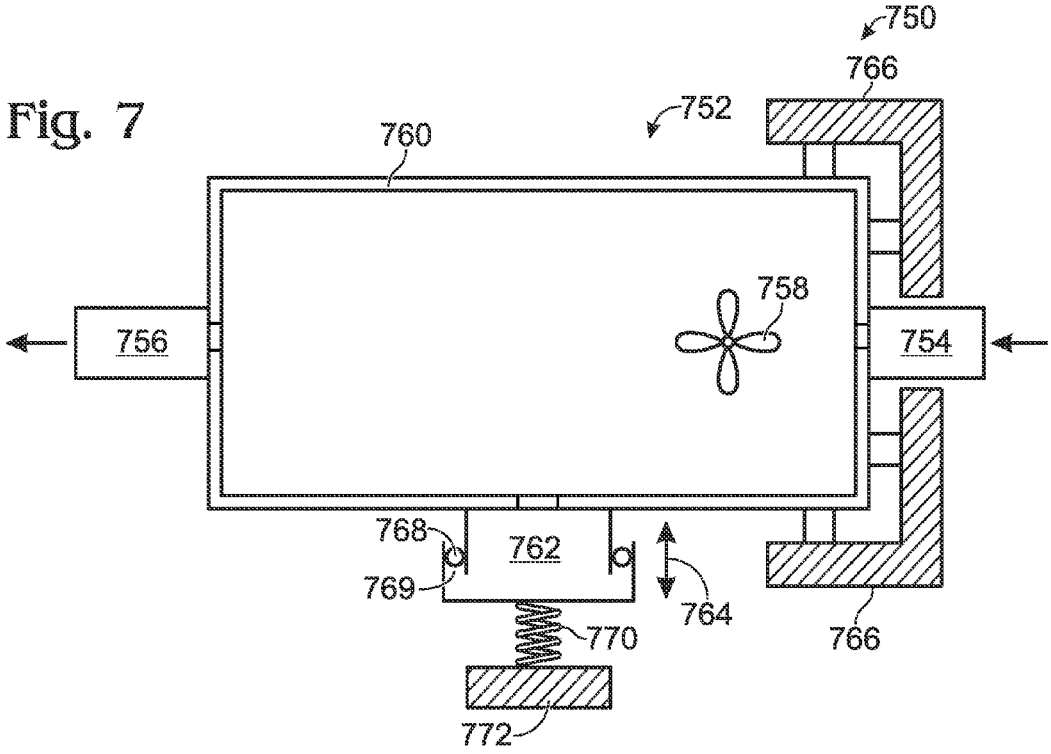
FIG. 7 is a schematic diagram of a second exemplary embodiment of a pump head equipped with a volume-compensation feature different from that shown in FIG. 6.

A variation of the general configuration is shown in FIG. 7, showing a pump head 750 including a housing 752, an inlet 754, an outlet 756, and a pump element 758 located inside the housing. The housing 752 includes a first portion 760 and a second portion 762. The second portion 762 is movable relative to the first portion 760 (see arrow 764). A structure 766 substantially immobilizes the first portion 760, allowing the second portion 762 to move relative to the first portion 760 in response to a pressure change inside the housing 752. Movement of the second portion 762 desirably is against a bias 770 (e.g., a compression spring) held by a stationary structure 772. The second portion 762 is connected to the first portion 760 at an expansion joint 769 including a dynamic seal 768 (e.g., an O-ring).

The bias 770 and actuation of the pump element 758 establish a nominal pressure inside the housing 752. If the internal pressure increases, the second portion 762 automatically moves downward in FIG. 7, relative to the first portion 760, to increase the volume inside the housing 752, thereby reducing the internal pressure so as to prevent the pump head from fracturing or developing cracks. If the internal pressure decreases, the second portion 762 automatically moves upward in FIG. 7, relative to the first portion 760, to decrease the volume inside the housing 752 and thereby increase the internal pressure.

Figure 8:
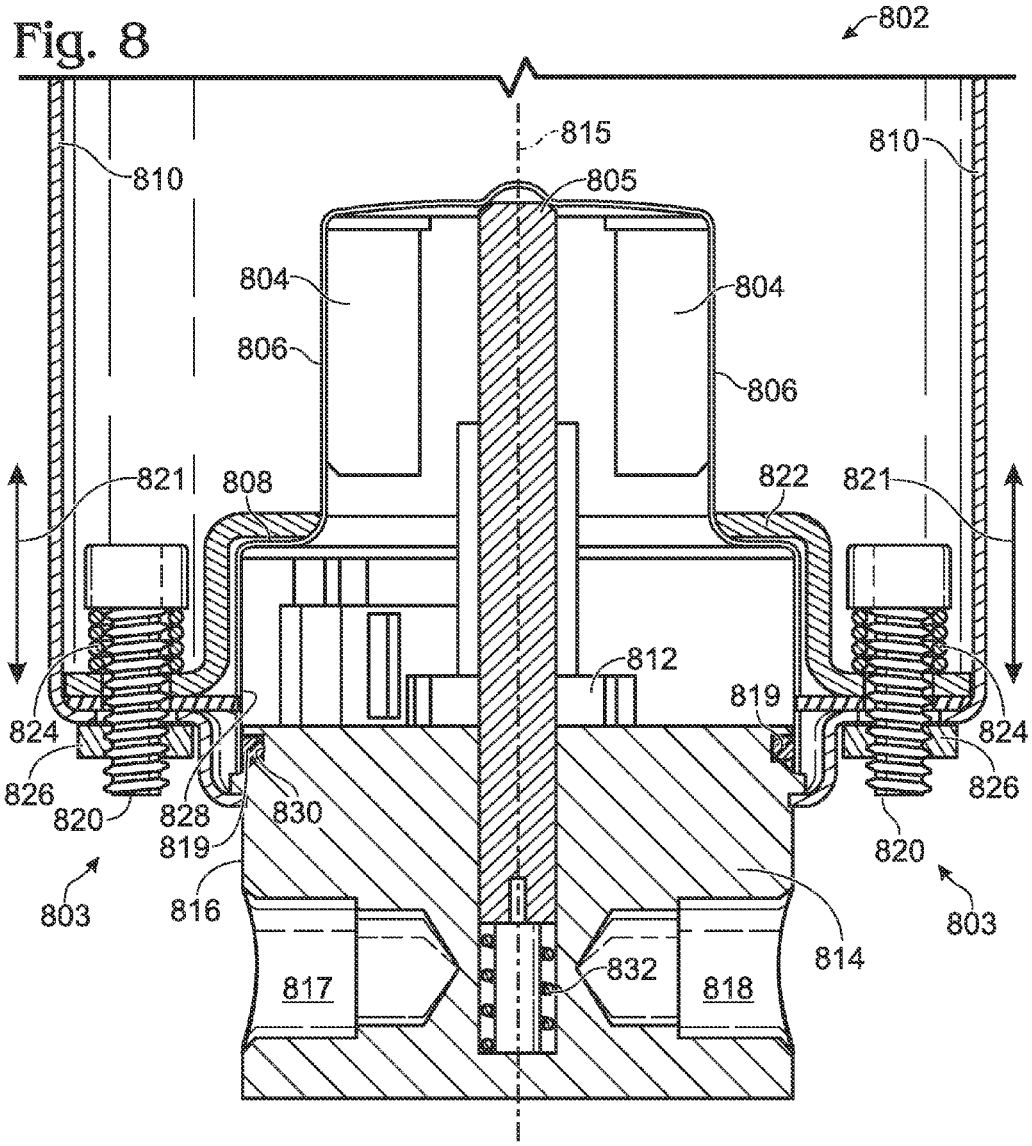
FIG. 8 is a cross-sectional view of a magnetically driven gear pump similar to that shown in FIGS. 1-5, equipped with an expansion joint biased with spring coils to provide volume compensation.

A more specific configuration is shown in FIG. 8, which is a cross-section of a gear pump 802 featuring a pair of expansion features 803. The gear pump 802 is driven by a rotating magnet 804 mounted to a spring-loaded shaft 805 surrounded by a magnet cup 806. A pump housing 810 comprises three portions: the magnet cup 806, a portion 808 that extends proximally from the magnet cup, and a pump block 814. The portion 808 encloses pump elements such as gears 812. Respective axles for the gears 812 and for the magnet 804 are secured in the pump block 818 along an axis 815, about which the gear pump 802 is generally symmetric. The magnet cup 806 and portion 808 are contiguous with each other, but the portion 808 as shown in FIG. 8 has a greater diameter than the magnet cup 806 to accommodate the pump elements 812. A pump block 818 having a cylindrical outside surface 816 defines a pump inlet 817 and a pump outlet 818. The housing portions 806, 808, and pump block 818 collectively constitute a pressure vessel of the pump 802 and collectively establish a pressure boundary of the pump 802. The magnet cup 806 and magnet 804 are coaxial with and surrounded by a stator (not shown) located inside the housing 810. The housing 810 and the stator are located outside the pressure boundary of the pump.

The housing portions 806, 808 and the pump block 818 collectively define the pump housing. The portions 806, 808 can be regarded as a first housing portion that is slidable as a unit relative to the pump block 818, which can be regarded as a second housing portion. The first and second housing portions are in hydraulic communication with each other and are both wetted by the pumped fluid. Note arrows 821 in FIG. 8, indicating a volumetric expansion of the housing by upward movement of the portions 806, 808 relative to the pump block 818. Meanwhile, pressure integrity inside the pump housing is maintained, despite such movement, by a sliding dynamic seal 819 (e.g., a radial O-ring) located between the inside wall of the housing portion 808 and the outside wall of the pump block 818. As shown in FIG. 8, the sliding seal 819 allows for axial movement of the pressure boundary (portions 806, 808, collectively) so as to alleviate a substantial increase in pressure that otherwise would occur if, for example, the primed liquid contents of the pump housing became frozen. As the portions 806, 808 move, they impart a corresponding displacement of a connecting ring 822 against a bias provided by springs 824. The springs 824 are held in place by screws 820 extending through the connecting ring 822, and through the housing 810, and threaded into a securing ring 826 attached to the pump block 818. As the portions 806, 808 move, the shaft 805 also moves, such that when the springs 828 are compressed, the shaft spring 832 is correspondingly released, and vice versa. At the end opposite shaft spring 832, motion of the shaft 805 is constrained by the magnet cup 806.

The sliding dynamic seal 819 extends circumferentially around the pump block 818. The sealing area is against an inside-diameter surface 828 of the first housing portion 806, 808. As the first housing portion 806, 808 is allowed to move in the axial direction against the spring bias, the seal 819 retains its sealing integrity. The seal 819, situated in a circumferential gland 830, defined in the cylindrical outside surface of the pump block 818, allows the portion 808 to slide relative to it. This sliding motion generally does not affect the immediate environment or action of the pump gears 812, so the pumping action is generally unaffected, adversely or otherwise, by movement of the first housing portion 806, 808 relative to the second housing portion 818.

Thus, compensation for pressure increases in the pump housing (which could be due, for example, to expansion of freezing liquid inside the pump housing) is achieved by increasing the volume inside the pressure boundary by expanding a selected area of the housing walls. This represents a different approach than the configurations discussed in the '008 patent in which the pressure boundary of the housing is kept fixed, and fluid-volume expansions are compensated by decreasing the volume of a pressure-absorbing member located inside the pressure boundary. It will be understood that the embodiment of FIG. 8 (and of FIG. 9 discussed below) can include at least one internal pressure-absorbing member as discussed in the '008 patent publication, incorporated herein by reference.

Figure 9:
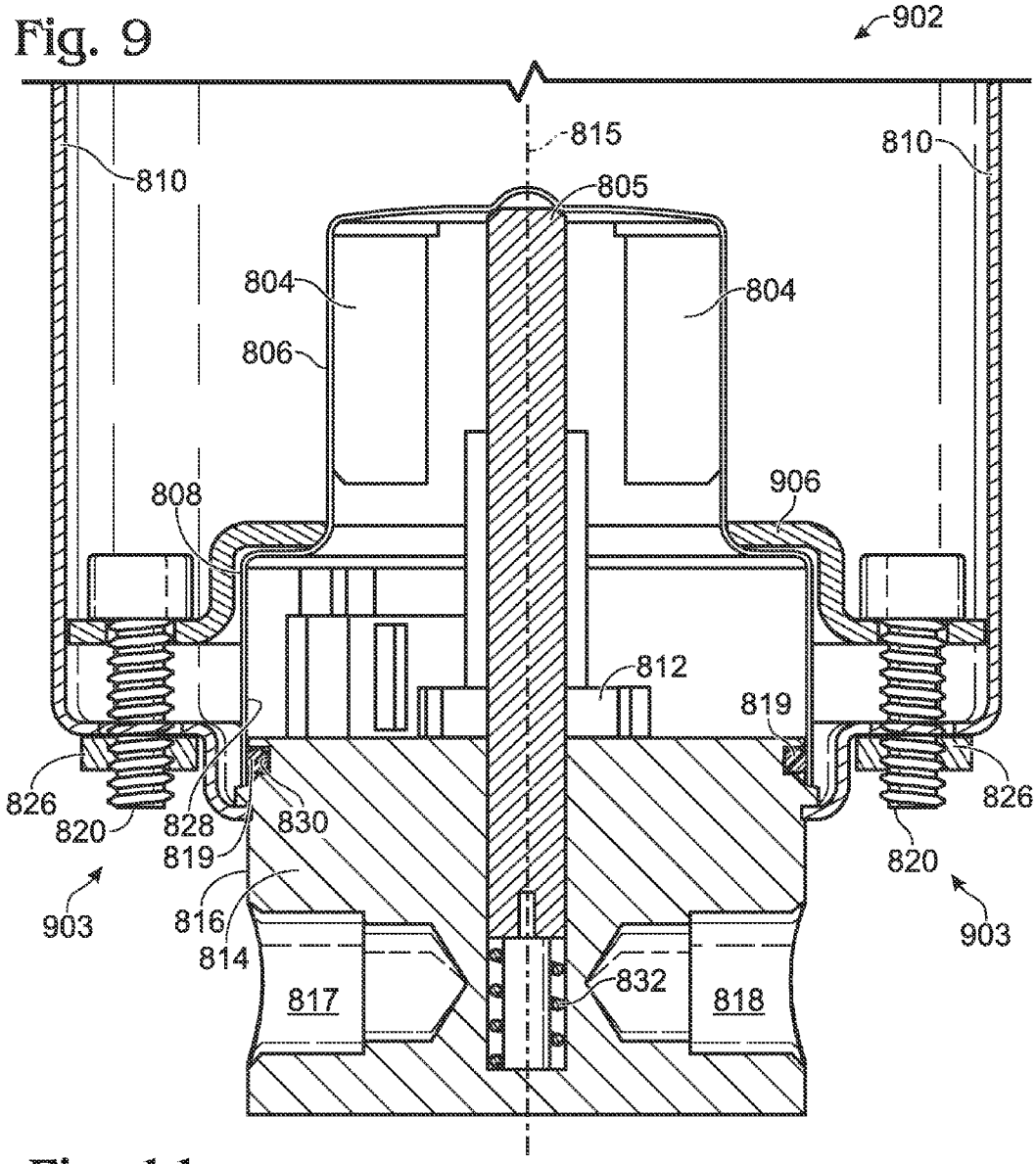
FIG. 9 is a cross-sectional view of a magnetically driven gear pump similar to that shown in FIGS. 1-5, equipped with an expansion joint that uses a spring-loaded clamp ring to provide volume compensation.

Another volume-compensating configuration is shown in FIG. 9, in which a gear pump 902 is equipped with a different type of expansion joint 903, similar to the embodiment of the expansion joint 803 shown in FIG. 8 except that, in the FIG. 9 embodiment, the springs 824 (serving as the bias) are replaced by a clamp ring 906 that is integrally spring-loaded and essentially functions as a spring washer. The embodiment of FIG. 9 is one example of a manner in which the spring(s) can be replaced by a combination of materials and/or structures to achieve a desired bias, or restoring force. In the depicted embodiment the clamp ring 906 both holds the portion 808 in place and provides the desired bias. Thus, the clamp ring has a shape that provides spring-loading on the portion 808 in the axial direction (vertical direction in the figure).

Figure 10:
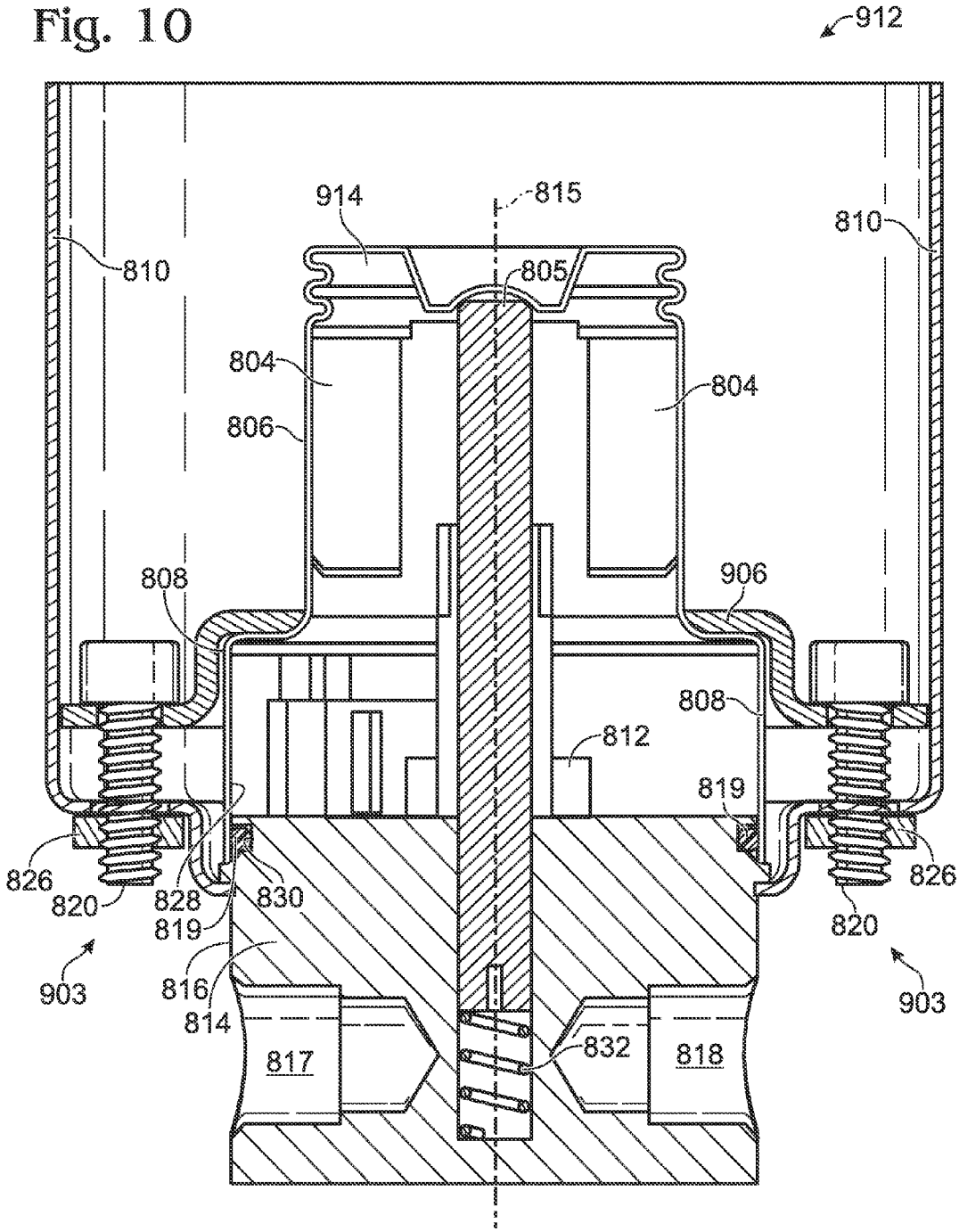
FIG. 10 is a cross-sectional view of a magnetically driven gear pump equipped with an expansion joint and a bellows.

Another exemplary embodiment of a gear pump is a bellows gear pump 912, as shown in FIG. 10. Bellows gear pump, 912 is similar to the gear pump 902 shown in FIG. 9, with the addition of a bellows 914 located at the magnet-cup end of the shaft 805. As shown, the bellows 914 provides a further bias to absorb expansion of the pump housing 810 through the expansion joint 903. An alternative configuration of a bellows gear pump may incorporate a bellows as a compliance means in place of the sliding seal 819, to provide elastic coupling within expansion joint 903.

An advantage of the foregoing embodiments is that their performance of pressure relief is done automatically and passively, simply in response to pressure conditions inside the pump housing. As the pressure increases, the volume inside the housing increases, and as the pressure decreases, the volume inside the housing decreases.

Figure 11:
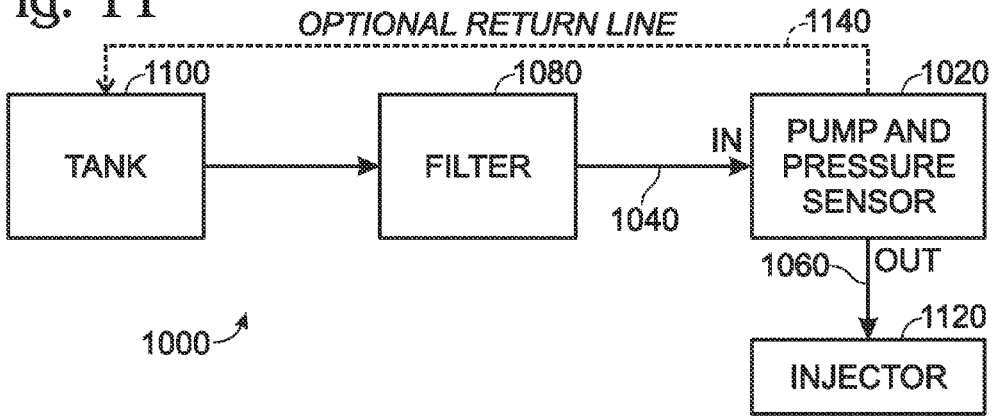
FIG. 11 is a block diagram of a hydraulic circuit comprising a pump equipped with a volume-compensation feature.

A hydraulic circuit 1000 comprising a pump, such as any of the specific embodiments described above, is shown in FIG. 11, which includes a pump and pressure sensor 1020 having an inlet 1040 and an outlet 1060. The inlet 1040 is situated downstream of a filter 1080, which is situated downstream of a tank 1100 serving as a reservoir for liquid to be pumped by the pump 1020. The outlet 1060 is hydraulically connected to a downstream injector 1120 or other component from which pumped liquid is discharged from the circuit 1000. If desired, the circuit 1000 can include a return line 1140 for returning liquid to the tank 1100 that is not actually discharged from the injector 1120. The circuit 1000 in FIG. 11 represents a circuit as used in an automotive application, in which at least the pump and pressure sensor 1020 is located in an environment that experiences episodes of freezing. Since the pump 1020 includes a pressure-relieving feature as described above, freeze-expansion of liquid inside the pump 1020 is accommodated, and pump damage is prevented.

The invention claimed is:

1. A pump, comprising:

a pump housing comprising pressure-boundary walls defining a pump cavity, the pump housing having first and second housing portions conjoined with each other by a dynamic seal allowing movement of at least one housing portion relative to the other housing portion in response to a pressure condition in the pump cavity by automatically changing a volume of the pump cavity at least while the pump cavity is primed with fluid, the housing further defining at least one inlet and at least one outlet;

a bias, situated relative to the first and second portions of the pump housing and providing a selected counter-force to the movement of the housing portion(s);

a movable pumping member situated in the pump cavity and, when driven to move, urging flow of the fluid from the inlet through the pump cavity to the outlet; and a mover coupled to the pumping member so as to drive pumping motions of the pumping member, wherein the first portion of the housing comprises a respective cylindrical portion, and the second portion of the housing comprises a respective cylindrical portion that is slip-fit into the cylindrical portion of the first portion; and the dynamic seal comprises at least one ring seal situated between the respective cylindrical portions.

2. The pump of claim 1, wherein the ring seal comprises at least one O-ring.

3. The pump of claim 1, wherein:

the respective cylindrical portion of the first portion of the housing comprises a magnet cup having an interior housing a driven magnet and that is a respective portion of the pump cavity; and the dynamic seal is between the magnet cup and the cylindrical portion of the second portion of the housing.

4. The pump of claim 1, wherein the bias comprises at least one compression spring.

5. The pump of claim 1, wherein the bias comprises a spring-loaded clamp ring.

6. A gear pump head, comprising:

a pump housing comprising pressure-boundary walls defining a sealed pump cavity, the pump housing having first and second housing portions conjoined with each other by a dynamic seal allowing movement of at least one housing portion relative to the other housing portion in response to a pressure condition in the pump cavity by automatically changing a volume of the pump cavity at least while the pump cavity is primed with fluid, the housing further defining at least one inlet and at least one outlet;

at least a driving gear and a driven gear enmeshed with each other in the pump cavity, and configured, when driven, to urge flow of the fluid from the inlet to the outlet; and a bias, situated relative to the first and second portions of the pump housing and providing a selected counter-force to motion of the at least one housing portion, wherein the pump housing further comprises a cup-housing, the cup-housing defining a cup-cavity in hydraulic communication with the gear cavity, the cup-cavity containing the fluid and a rotatable driven magnet that is coupled to the driving gear such that rotation of the magnet about its axis causes corresponding rotation of the driving gear and thus of the driven gear, the cup housing is rotationally symmetrical to the axis of rotation of the magnet situated in the cup housing, the cup housing is a part of the first housing portion that moves relative to the second housing portion, and the first housing portion moves along the axis relative to the second housing portion to increase the volume of the housing in response to a pressure increase in the housing and to decrease the volume of the housing in response to a pressure decrease in the housing.

7. The gear pump head of claim 6, wherein:

the first housing portion includes a portion enclosing the gears;

the second housing portion comprises a pump block including the inlet and outlet; and the dynamic seal is located between an inside surface of the first housing portion and an outside surface of the second housing portion.

8. The gear pump head of claim 6, wherein the bias comprises at least one coil spring.

9. The gear pump head of claim 6, wherein the bias comprises at least one spring-washer.

10. A fluid pump, comprising:

a fluid inlet;

a fluid outlet;

a pump housing, comprising pressure-boundary walls defining a pump cavity having a cavity volume, the pump cavity containing a fluid at a fluid pressure; a first housing portion connected to the fluid inlet; a second housing portion connected to the fluid outlet; a bias; and an expansion joint by which at least one of the housing portions is movable relative to the other housing portion against the bias to expand the cavity volume in response to an increase in fluid pressure in the pump cavity, and to contract the cavity volume in response to a decrease in fluid pressure in the pump cavity;

a movable pumping member situated in the pump cavity, the pumping member urging flow of the fluid from the inlet through the pump cavity to the outlet; and a mover coupled to the pumping member, the mover being drivable to cause pumping motions of the pumping member in the pump cavity, wherein the expansion joint comprises a bellows, and the bias provides a selected counter-force to the movement of the housing portion (s).

11. The fluid pump of claim 10, further comprising a bellows that expands and contracts in response to motion of the housing portion(s).

* * * * *